US005924129A

United States Patent [19]

Gill

[11] Patent Number: 5,924,129

[45] Date of Patent: Jul. 20, 1999

[54] SUNGUARD FOR USE WITH HEADGEAR

[76] Inventor: Jeannie Gill, 59310 Mt. Pleasant Rd., Bogalusa, La. 70427

[21] Appl. No.: 09/058,326

[22] Filed: Apr. 9, 1998

[51] Int. Cl.[6] ..... A42B 1/18

[52] U.S. Cl. ..... 2/10; 2/172; 2/173; 2/206; 2/207

[58] Field of Search ..... 2/10, 172, 207, 2/209.13, 173, 424, 9, 206

[56] References Cited

U.S. PATENT DOCUMENTS

| | | | |
|---|---|---|---|
| 2,344,811 | 3/1944 | Gill . | |
| 2,856,607 | 10/1958 | Richardson | 2/172 |
| 5,035,004 | 7/1991 | Koester | 2/10 |
| 5,355,535 | 10/1994 | Bruder | 2/172 |
| 5,542,127 | 8/1996 | Bezanis | 2/172 |
| 5,649,327 | 7/1997 | Crewe | 2/172 |
| 5,655,255 | 8/1997 | Mathers | 2/172 |
| 5,669,074 | 9/1997 | Newman, Jr. | 2/172 |
| 5,669,075 | 9/1997 | Weeks | 2/172 |
| 5,701,609 | 12/1997 | Bridges | 2/172 |

*Primary Examiner*—Diana L. Biefeld
*Attorney, Agent, or Firm*—Keaty & Keaty

[57] ABSTRACT

The invention relates to a sun protective shield worn with a headgear to protect face of a wearer from ultraviolet radiation. The shield is flexible, air permeable and optically transparent so as not to impede breathing or vision of the user. The shield has a first set of securing tabs adjacent the top edge of the shield for securing to a piece of headgear, and a second set of securing tabs for retaining the shield in any of a plurality of folded positions. The second set of tabs engages with the first set of tabs when the shield is partially or fully folded, covering the entire face of the user or only a part thereof.

7 Claims, 2 Drawing Sheets

SUNGUARD FOR USE WITH HEADGEAR

BACKGROUND OF THE INVENTION

This invention relates to a sun protective device attachable to a headgear for the purpose of protecting the user from ultraviolet radiation. More particularly, the invention relates to a flexible shield to be worn by a user during outdoor activities.

In recent years, considerable information has been collected on the dangers of ultraviolet rays' exposure. The most evident demonstration of sun-caused damage is a wrinkled skin, which many people find objectionable. Wrinkles occur because the elastic fibers that keep skin taut gradually loosen over time. The ultraviolet rays of the sun attack person's immune system and increase production of the enzymes that break down collagen supporting the skin. More dangerous, though, is skin cancer, such as melanoma, that affects thousands of people each year. This type of skin cancer is most dangerous and often leads to fatal results.

Consequently, dermatologists strongly advise to limit sun exposure and to protect skin by using sunscreens, and wearing hats and sunglasses. While manufacturers of facial products introduce new creams on the market for improving sun-damaged skin, the best line of defense remains prevention.

To this end, various devices have been invented for covering sun-exposed areas of the body during outdoor activities. Some of these devices suggest using a fabric shield, such as a bandana, which is placed under a baseball-type cap. Others use fabric pieces to cover the neck and ear areas of the body. Still others provide for the use of a transparent shield attachable by zipper or other suitable means to a hat. While these devices function satisfactory under many circumstances, there is still a need for a simple, inexpensive sun shield that can be easily positioned and removed from a piece of headgear.

SUMMARY OF THE INVENTION

It is, therefore, an object of the present invention to provide a sun protective device for shielding a wearer's face from ultraviolet rays during outdoor activities.

It is another object of the present invention to provide a sun guard that can be easily positioned and removed from conventional headgear.

A further object of the invention is to provide a sun-protective device that is lightweight enough to be carried on a conventional piece of a headgear without discomfort to a wearer.

These and other objects of the present invention are achieved through a provision of a sun shield, or sun guard that is fixedly or detachably attachable on a headgear above a visor. The top edge of the shield is securable to the headgear by Velcro tabs or strips, or by other securing means, such as snaps, buttons and the like.

A second set of securing tabs is attached to the shield a distance below the top edge and adjacent to the sides of the shield. The second set of tabs is engageable with the first set of securing means, allowing to retain the shield in a plurality of folded positions, covering the face of a wearer below the chin above the mouth, etc., as desired by the user.

The shield is formed from a flexible, air-permeable, optically transparent material that does not impede breathing or vision of the user, and can be easily folded.

BRIEF DESCRIPTION OF THE DRAWINGS

Reference will now be made to the drawings, wherein like parts are designated by like numerals, and wherein.

DETAIL DESCRIPTION OF THE PREFERRED EMBODIMENT

Figure 3:
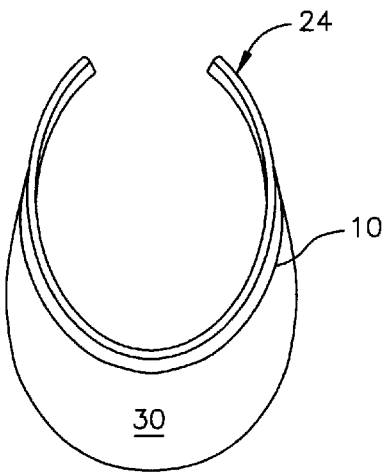
FIG. 3 is a top view of the visor, with the sun shield rolled up and secured on the headband.
Figure 5:
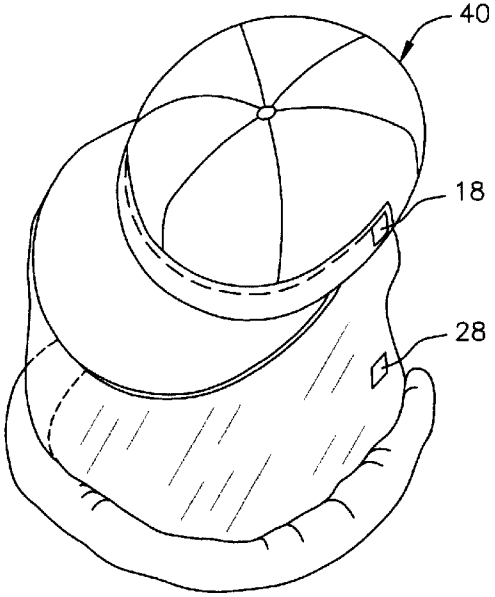
FIG. 5 is a perspective view of the sun shield secured on a cap, with the shield partially rolled up.
Figure 6:
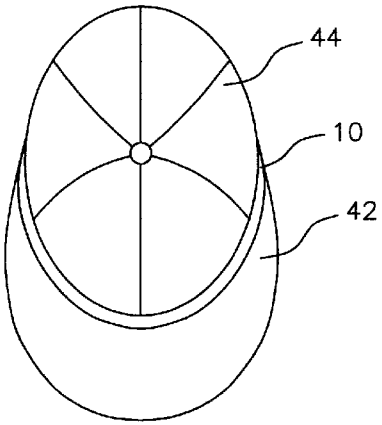
FIG. 6 is a top view of the cap with the sun shield in a wrapped position about a headband of the cap.
Figure 4:
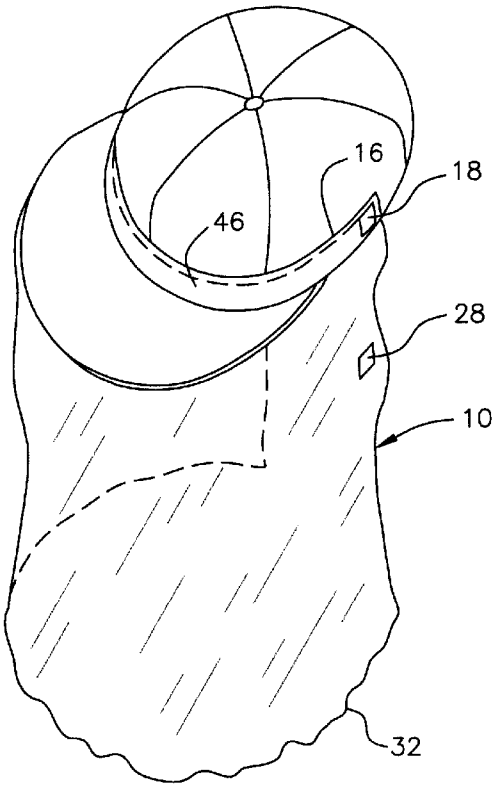
FIG. 4 is a perspective view of the sun shield of the present invention secured on a baseball-type cap.

Referring now to the drawings in more detail, numeral 10 designates the sun shield, or guard in accordance with the present invention. The guard 10 has an outer surface 12 and an inner surface 14. A top edge 16 of the sun guard 10 is provided with two or more first securing members, or tabs 18. The tabs 18, in a preferred embodiment, are formed with hook and loop fasteners to allow mating engagement with similar securing elements attached to an outer surface 20 of a headband 22. The headband 22 can be a part of a visor 24 (FIGS. 1–3) or a cap 40 (FIGS. 4–6). The securing tabs 18 can be formed with both inner and outer surfaces carrying hook and loop fasteners, that is double-sided securing elements. The tabs 18 can be stitched or glued to the shield body in a manner well known to those skilled in the art.

It is preferred that the securing elements 18 be located adjacent opposite side edges 25 and 26 of the guard 10. In this manner, the shield 10 can be stretched taut around the headband 22 and securely positioned on the headband. Of course, one or more additional securing elements 18 can be provided along the edge 16, arranged at equal distances, if desired.

A second set of securing elements, or tabs 28 is stitched or glued a distance below from the first set of tabs 18, with the second securing elements 28 being positioned on the inner surface 14 of the sun guard 10 adjacent to the sides of the shield body. The purpose of the second securing elements 28 will be described in more detail hereinafter.

The sun guard 10 is made from an optically transparent, highly flexible porous material that is lightweight, so as not to increase the weight of the headgear in any appreciable manner. The width of the shield 10 is sufficient to extend around approximately one half of the headband 24 and, when unrolled, cover the face of the user. The shield 10 is long enough to extend below the chin of the user, when unfolded to a position shown in FIG. 1. Because the shield first covers the visor 30, then extends downwardly below the chin of a wearer, the shield 10, when unfolded, is spaced to some distance from the wearer's face. In this manner, any discomfort to the user is minimized.

The shield 10, being porous, or air permeable, allows the user to breathe normally, as well as to see through the unfolded shield 10. Optionally, the guard 10 can be provided with a coating on the outer surface 12 to increase an ability of the shield to deflect or block harmful ultraviolet rays. Of course, such coating should not impede transparency and air permeability, of the shield.

Figure 1:
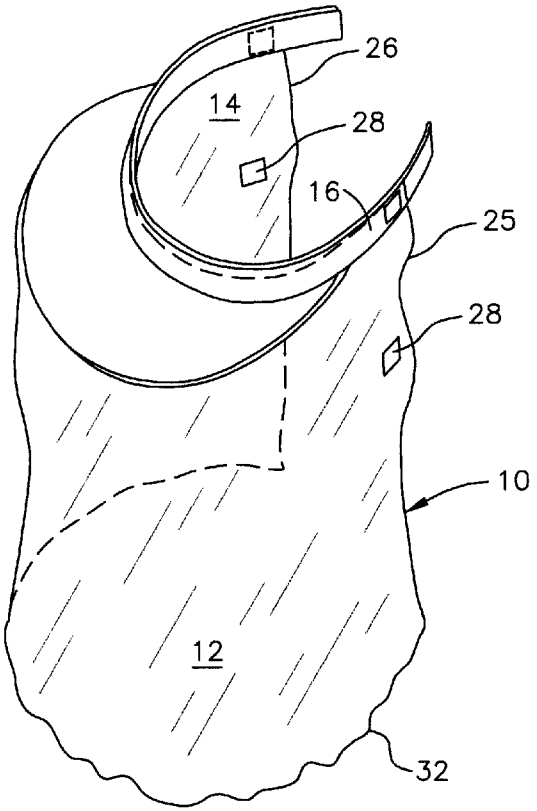
FIG. 1 is a perspective view of the present invention as secured on a conventional visor.

The guard 10, when fully rolled or folded, can be carried in a pocket, purse or other convenient location. When the user wishes to protect his or her face from the sun, the user unfolds the sun guard 10 and holds it by opposite corners adjacent to the top edge 16. The securing elements 18 are then brought into engagement with the matching securing elements fixedly attached to the outer surface 20 of the headband 22. The sun guard 10 is then allowed to unroll over the visor member 30 and move downwardly to its fully extended position, as shown in FIG. 1. The user then places the visor with the sunshield on his or her head, moving the sun guard 10 in front of the face.

When the guard 10 is no longer needed, it can be disengaged from the visor 24 by unfastening the elements 18 from the matching elements on the headband 22. The shield 10 can then be rolled or folded and stored away. However, should the user decide to temporarily stop using the shield 10, such as when driving or going indoors for a short period of time, the user can roll up the shield starting with the bottom edge 32, making sure that the inner surface 14 of the shield 10 is on top.

Once the shield 10 is folded or rolled up above the visor member 30, the fastening elements 28 are brought into engagement with the outer surfaces of the fastening elements 18, and the shield 10 is secured in its folded position on the headband 22, above the visor member 30. The shield 10 will remain folded on the visor 30 until such time as the user is ready to use it again or to remove for storage.

Of course, the visor 10 can be provided with permanently attached guard 10. In such a case, the fastening elements 18 can be provided with hook and loop fasteners on the outer surface only, while the inner surface is fixedly secured to the headband 22.

Turning now to FIGS. 4–6, the shield 10 is shown positioned on the baseball-type cap 40. In this case, the shield 10 can be secured immediately above a visor member 42, on the soft fabric forming the skull-covering portion 44 of the conventional cap 40. The securing elements 18 are arranged for engagement with matching securing members on the portion 44 at an approximate location above the temples of the wearer. The top part of the shield 10, adjacent to the tope edge 16 can be reinforced with a stiff material, if desired, so as to form a band 46 that is easily positioned above the visor member 42. The same arrangement can be used with the visor 24, if desired.

The securing elements 18 can be formed double-sided, or one-sided, that is provided with securing means, such as hook and loop fasteners on one or both sides, as described above. Depending on the manner the sun shield 10 is used, it can be fixedly or detachably attached to the cap 40. When not in use, the guard 10 can be rolled up and secured with the second set of securing elements 28, resting on the visor member 42, as shown in FIG. 6.

If desired, the securing tabs 18 and 28 can be substituted by a strip of stiffening material having a length substantially equal to or smaller than the width of the shield body. The stiffening material, by itself, can form a band similar to the band(s) shown in FIGS. 4 and 5. The strip can be provided with hook and loop fasteners along substantially the entire length of the strip, on one or both sides of the strip. In this case, the mating fastening elements on the cap can be formed as an elongated strip or as a plurality of small tabs spaced above the visor member 42.

It is also envisioned that the shield 10 can be fixedly attached to the headgear and manufactured as one unit. In such a case, it is possible to secure the tabs 18 directly on the cap or other headgear and provide securing means, be it hook and loop fasteners, buttons, snaps and the like on the outer surface of the tabs 18. These buttons, snaps, etc. can then be engaged with similar such securing means 28 attached to the shield body below the top edge of the shield.

Figure 2:
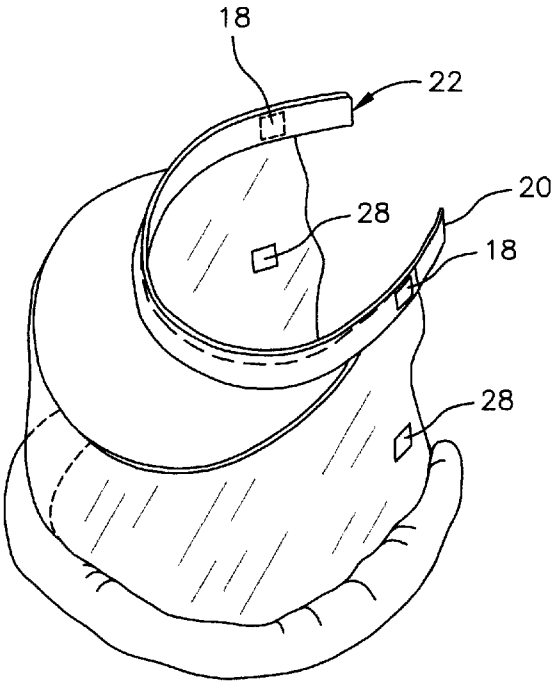
FIG. 2 is a perspective view of the sun guard of the present invention, positioned on the visor and partially rolled up.

The shield 10 can be also partially folded, for instance, as shown in FIGS. 2 and 5 if the user wants to cover the upper part of the face only. In such a case, the shield 10 is lifted by the second tabs 28, and the tabs 28 are brought into engagement with the first tabs 18 to keep the shield 10 in a partially lifted position. A plurality of such intermediate positions can be easily selected by the wearer, extending or folding the sun guard 10, as desired.

Many other changes and modifications can be made in the sun shield device of the present invention without departing from the spirit thereof I, therefore, pray that my rights to the present invention be limited only by the scope of the appended claims.

I claim:

1. A sun protection device for use with headgear having a visor member, the device comprising:

a flexible optically-transparent porous shield having a top edge, an inner surface and an outer surface, said shield being sized and shaped to extend downwardly over the visor member and cover a face of a wearer when the shield is in an unfolded position;

a first securing means fixedly attached adjacent to the top edge of the shield for securing the top edge of the shield above the visor member of the headgear, said first securing means comprising a pair of first securing tabs provided with hook and loop fasteners for mating engagement with tabs secured on the headgear above the visor member, said tabs being secured at opposite upper corners of the shield, wherein each of said securing tabs has an inner surface and an outer surface, and wherein said hook and loop fasteners are provided on said inner surface and said outer surface of said securing tabs;

a second securing means fixedly attached to the inner surface of said shield a distance below said first securing means, said second securing means being adapted for retaining said shield in a folded position above the visor member.

2. The device of claim 1, wherein said second securing means comprises a pair of second securing tabs, each second securing tab being provided with hook and loop fasteners on an outer surface thereof.

3. The device of claim 1, further provided with a stiffening layer formed along the top edge of the shield.

4. A sun protection device for a headgear having a visor member, said device comprising:

a flexible, air-permeable, optically transparent shield having a top edge, an inner surface and an outer surface, said shield being moveable between a fully unfolded position covering said visor member and extending downwardly in covering relationship over a face of a wearer, a folded position above the visor member and a plurality of intermediate positions;

a first securing means for retaining said shield on said headgear, said first securing means being fixedly attached adjacent to the top edge of said shield and being adapted for detachable engagement with said headgear above said visor, said first securing means comprising a plurality of first securing tabs, each of said first securing tabs being provided with hook and loop fasteners on an inner and outer surface thereof;

a second securing means for retaining said shield in any of a plurality of folded positions, said second securing means being secured a distance below said first securing means.

5. The device of claim 4, wherein said second securing means is mounted on the inner surface of said shield.

6. The device of claim 4, wherein said second securing means comprises a plurality of second tabs, each of second tabs being provided with hook and loop fasteners for mating engagement with said first tabs.

7. The device of claim 4, wherein said shield is further provided with a stiffening strip along the top edge of the shield, said stiffening strip carrying said first securing means.

* * * * *